US005649486A

United States Patent [19]

Lewis

[11] Patent Number: 5,649,486

[45] Date of Patent: Jul. 22, 1997

[54] THIN-METAL LITHOGRAPHIC PRINTING MEMBERS WITH VISIBLE TRACKING LAYERS

[75] Inventor: Thomas E. Lewis, E. Hampstead, N.H.

[73] Assignee: Presstek, Inc., Hudson, N.H.

[21] Appl. No.: 508,330

[22] Filed: Jul. 27, 1995

[51] Int. Cl.[6] ..... B41N 1/14

[52] U.S. Cl. ..... 101/453; 101/460

[58] Field of Search ..... 101/453–462, 101/467; 430/200, 201, 302, 303, 945

[56] References Cited

U.S. PATENT DOCUMENTS

| | | | |
|---|---|---|---|
| 3,559,576 | 2/1971 | Vrancken et al. | 101/460 |
| 3,745,586 | 7/1973 | Braudy | 101/471 |
| 3,945,318 | 3/1976 | Landsman | 101/467 |
| 4,086,093 | 4/1978 | Ezumi et al. | 101/453 |
| 4,245,003 | 1/1981 | Oransky et al. | 428/323 |
| 4,588,674 | 5/1986 | Stewart et al. | 430/273 |
| 4,976,198 | 12/1990 | Ohba et al. | 101/459 |
| 5,156,938 | 10/1992 | Foley et al. | 430/200 |
| 5,258,263 | 11/1993 | Cheema et al. | 101/463.1 |
| 5,339,737 | 8/1994 | Lewis et al. | 101/454 |
| 5,378,580 | 1/1995 | Leenders | 101/467 |
| 5,379,698 | 1/1995 | Nowak et al. | 101/454 |
| 5,417,164 | 5/1995 | Nishida et al. | 101/467 |
| 5,429,909 | 7/1995 | Kaszczuk et al. | 430/273 |
| 5,503,074 | 4/1996 | Hirano et al. | 101/457 |

FOREIGN PATENT DOCUMENTS

| | | | |
|---|---|---|---|
| 1050805 | 3/1979 | Canada | 101/467 |
| 573091 | 12/1993 | European Pat. Off. . | |
| 573092 | 12/1993 | European Pat. Off. . | |
| 1208731 | 10/1966 | United Kingdom . | |

OTHER PUBLICATIONS

Research Disclosure, Apr. 1980, "Method and material for the production of a dry planographic printing plate", p. 131 Leenders et al.

"Direct Method of Producing Waterless Offset Plates by Controlled Laser Beam" Nechiporenko et al., pp. 139–148, USSR Research Institute for Complex Problems in Graphic Arts.

*Primary Examiner*—Stephen R. Funk

*Attorney, Agent, or Firm*—Cesari and McKenna

[57] ABSTRACT

Laser-imageable, ablation-type lithographic printing members have a colorant that provides contrast between plate layers of similar tonalities. In particular, the colorant observably distinguishes the ablation layer from visible underlying layers, but which does not substantially interfere with the action of the imaging pulses.

24 Claims, 1 Drawing Sheet

THIN-METAL LITHOGRAPHIC PRINTING MEMBERS WITH VISIBLE TRACKING LAYERS

BACKGROUND OF THE INVENTION

1. Field of the Invention

The present invention relates to digital printing apparatus and methods, and more particularly to lithographic printing plate constructions that may be imaged on- or off-press using digitally controlled laser output.

2. Description of the Related Art

U.S. Pat. Nos. 5,339,737 and 5,379,698, the entire disclosures of which are hereby incorporated by reference, disclose a variety of lithographic plate configurations for use with imaging apparatus that operate by laser discharge (see, e.g., U.S. Pat. No. 5,385,092 and U.S. application Ser. No. 08/376,766). These include "wet" plates that utilize fountain solution during printing, and "dry" plates to which ink is applied directly.

In particular, the '698 patent discloses laser-imageable plates that utilize thin-metal ablation layers which, when exposed to an imaging pulse, decompose into gases and volatile fragments even at relatively low power levels. The remaining layers are solid and durable, generally of polymeric or thicker metal composition, enabling the plates to withstand the rigors of commercial printing and exhibit adequate useful lifespans.

In one general embodiment, the plate construction includes a first, topmost layer chosen for its affinity for (or repulsion of) ink or an ink-abhesive fluid. Underlying the first layer is a thin metal layer, which ablates in response to imaging (e.g., infrared, or "IR") radiation. A strong, durable substrate underlies the metal layer, and is characterized by an affinity for (or repulsion of) ink or an ink-abhesive fluid opposite to that of the first layer. Ablation of the absorbing second layer by an imaging pulse weakens the topmost layer as well. By disrupting its anchorage to an underlying layer, the topmost layer is rendered easily removable in a post-imaging cleaning step. This, once again, creates an image spot having an affinity for ink or an ink-abhesive fluid differing from that of the unexposed first layer.

In this type of construction, imaged areas are easily distinguished from unimaged areas. The substrate is typically clear, so that the silvery appearance of regions that have not received laser exposure ordinarily contrasts with the surface (e.g., a plate cylinder or inspection table) underlying the printing member. This is not, however, the case with other types of constructions.

For example, as outlined in the '737 patent and U.S. Pat. No. 5,570,636 entitled LASER-IMAGEABLE LITHOGRAPHIC PRINTING MEMBERS WITH DIMENSIONALLY STABLE BASE SUPPORTS (the entire disclosure of which is hereby incorporated by reference), it is possible to laminate the above-described construction to a metal support that not only provides dimensional stability, but also acts to reflect unabsorbed imaging radiation back into the thin metal layer. Assuming clear substrate and laminating adhesive materials, however, the metal support is likely to offer little contrast to the thin-metal imaging layer.

Also as described in the '636 patent, it is possible to utilize thin-metal imaging layers over metal base supports without lamination. Although thermally conductive metal supports would dissipate imaging energy if disposed directly beneath the thin metal layer, the '636 patent details constructions that concentrate heat in the thin metal layer, preventing (or at least retarding) its transmission and loss into the base support. To accomplish this, a thermally insulating layer is interposed between the imaging layer and the thermally conductive base support. Once again, assuming that the insulating layer is fabricated from a clear polymeric material, contrast between the thin metal layer and the metal base support will be minimal.

Printers have traditionally exploited contrast between imaged and unimaged plate regions to facilitate visual inspection. Typically, the press operator first utilizes the gross patterns to ensure that the plate corresponds to the current job, and that the series of plates on successive plate cylinders correspond to one another. He can then inspect the contrasting regions of the plates more closely, verifying proper overall imaging and the presence of key details prior to operating the press. The absence of contrast makes it difficult or impossible for a press operator to perform these identification and inspection activities by examination of the plate. Although the press operator can prepare a proof to obtain direct visualization of the plate image, this is time-consuming operation, particularly in a computer-to-plate environment.

DESCRIPTION OF THE INVENTION

BRIEF SUMMARY OF THE INVENTION

The present invention provides contrast between plate layers having similar tonalities. The approach contemplated herein may be applied to any of a variety of laser plate constructions imageable by radiation of varying peak wavelengths. In particular, the invention is suited to plates imageable with solid-state lasers as described in the '092 patent at pulse times in excess of 1 μsec, typically from 5–13 μsec, and longer if desired. As used herein, the term "plate" refers to any type of printing member or surface capable of recording an image defined by regions exhibiting differential affinities for ink and/or fountain solution; suitable configurations include the traditional planar lithographic plates that are mounted on the plate cylinder of a printing press, but can also include cylinders (e.g., the roll surface of a plate cylinder), an endless belt, or other arrangement.

All constructions of the present invention utilize thin metal layers that ablatively absorb laser radiation. Generally, preferred imaging wavelengths lie in the IR, and preferably near-IR region; as used herein, "near-IR" means imaging radiation whose $lambda_{max}$ lies between 700 and 1500 nm. An important feature of the present invention is its usefulness in conjunction with solid-state lasers (commonly termed semiconductor lasers and typically based on gallium aluminum arsenide compounds) as sources of imaging radiation; these are distinctly economical and convenient, and may be used in conjunction with a variety of imaging devices. The use of near-IR radiation facilitates use of a wide range of organic and inorganic absorption materials.

The printing members of the present invention contain a colorant that observably distinguishes the ablation layer from visible underlying layers, but which does not substantially interfere with the action of the imaging pulses. In one embodiment, the printing member comprises a topmost layer, a thin metal imaging layer and a polymeric substrate comprising a material (such as a dispersed pigment, e.g., barium sulfate) that reflects imaging radiation and is tonally similar to the thin metal layer. In accordance with the invention, the colorant is chemically integrated, dispersed or dissolved within the polymer matrix of the substrate. Alternatively, because the topmost layer is removed as a consequence of the imaging process, it is possible to locate the colorant in this layer instead of (or in addition to) the substrate.

In a second embodiment, a construction comprising a topmost layer, a thin metal imaging layer and a polymeric substrate is laminated to a metal base support that is tonally similar to the imaging layer. A first version of this embodiment locates the colorant in the substrate layer, so that if the base support reflects unabsorbed imaging radiation, this will pass back to the thin metal layer through the colorant-containing substrate without significant absorption. In a second version, the colorant is located in the laminating adhesive. This second approach is advantageous in that it permits observation, for quality-control purposes, of the uniformity of the adhesive layer. Indeed, even in applications where visible contrast between imaged and unimaged plate regions is unnecessary (or perhaps even undesirable), a dye that is invisible under ambient light but observable under special conditions (e.g., which fluoresces under ultraviolet light) can be located within the adhesive layer. In a third version of this embodiment, the colorant is located in the topmost layer as discussed above.

The colorant may be a dye, a pigment or a combination thereof, although dyes are preferred. As used herein, the terms "colorant" and "contrast material" are intended to connote materials imparting contrast observable under ordinary or special conditions. Pigments should have refractive indices that substantially match that of the surrounding medium in order to avoid scattering and absorption of imaging radiation. Because the colorant is ordinarily added to polymeric materials, this matching is most readily accomplished with organic pigments. Because a dye chromophore is present at the molecular level, dyes can be very finely dispersed or even fully dissolved in a carrier matrix, eliminating the surface, refractive and interfacial effects that characterize particulate colorants. Preferred dyes are soluble in the polymer system employed and, in the case of hot-melt polymers, exhibit adequate thermal stability. Dyes can be added to polymer systems at loading levels of 1–5% by weight, although loading levels below 1% are possible in the case of very strong chromophores.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
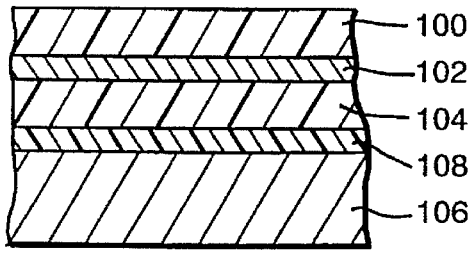
FIG. 1 is an enlarged sectional view of a lithographic plate embodying the invention and having a top layer, a radiation-absorptive layer, and a substrate laminated to a dimensionally stable support.

Refer first to FIG. 1, which shows the construction of a first type of printing member in accordance with the present invention. The member includes a polymeric surface layer 100, a layer 102 capable of absorbing imaging radiation, a substrate 104, and a base support 106 that reflects imaging radiation. Substrate 104 is anchored to base support 106 by means of a laminating adhesive. Both substrate 104 and laminating adhesive 108 are transparent to imaging radiation. Layers 100 and 104 exhibit opposite affinities for fountain solution and/or ink. In a dry plate, layer 100 is "abhesive" or repellent to ink, while substrate 104 is oleophilic and therefore accepts ink. Suitable oleophobic materials for layer 100 include, for example, silicone and fluoropolymers; layer 104 can be, for example, polyester. In a wet plate, layer 100 is hydrophilic and accepts fountain solution, while layer 104 is both hydrophobic and oleophilic. Suitable hydrophilic materials for layer 100 include, for example, chemical species based on polyvinyl alcohol. Working formulations of both polymer systems are set forth in detail in the '737 patent.

In a preferred form of this construction, layer 102 is at least one very thin (preferably 250 Å or less) layer of a metal, preferably titanium, deposited onto a polyester substrate 104. Exposure of this construction to a laser pulse ablates the thin metal layer and weakens the topmost layer and destroys its anchorage, rendering it easily removed. The detached topmost layer 100 (and any debris remaining from destruction of the imaging layer 102) is removed in a post-imaging cleaning step (in accordance with, for example, U.S. Pat. No. 5,148,746 and U.S. Pat. No. 5,568, 768).

Because such a thin metal layer may be discontinuous, it can be useful to add an adhesion-promoting layer to better anchor the surface layer to the other (non-metal) plate layers, as described, for example, in the '698 patent. Suitable adhesion-promoting layers, sometimes termed print or coatability treatments, are furnished with various polyester films that may be used as substrates. For example, the J films marketed by E.I. dupont de Nemours Co., Wilmington, Del., and Melinex 453 sold by ICI Films, Wilmington, Del. serve adequately. Generally, the adhesion-promoting layer will be very thin (on the order of 1 micron or less in thickness) and, in the context of a polyester substrate, will be based on acrylic or polyvinylidene chloride systems. In addition, it should be substantially transparent to imaging radiation.

Titanium is preferred for thin metal layer 102 because it offers a variety of advantages over other IR-absorptive metals. First, titanium layers exhibit substantial resistance to handling damage, particularly when compared with metals such as aluminum, bismuth, chromium and zinc; this feature is important both to production, where damage to layer 102 can occur prior to coating thereover of layer 100, and in the printing process itself where weak intermediate layers can reduce plate life. In the case of dry lithography, titanium further enhances plate life through resistance to interaction with ink-borne solvents that, over time, migrate through layer 100; other materials, such as organic layers, may exhibit permeability to such solvents and allow plate degradation. Moreover, silicone coatings applied to titanium layers tend to cure at faster rates and at lower temperatures (thereby avoiding thermal damage to substrate 104), require lower catalyst levels (thereby improving pot life) and, in the case of addition-cure silicones, exhibit "post-cure" cross-linking (in marked contrast, for example, to nickel, which can actually inhibit the initial cure). The latter property further enhances plate life, since more fully cured silicones exhibit superior durability, and also provides further resistance against ink-borne solvent migration. Post-cure cross-linking is also useful where the desire for high-speed coating (or the need to run at reduced temperatures to avoid thermal damage to substrate 104) make full cure on the coating apparatus impracticable. Titanium also provides advantageous environmental and safety characteristics: its ablation does not produce measurable emission of gaseous byproducts, and environmental exposure presents minimal health concerns. Finally, titanium, like many other metals, exhibits some tendency to interact with oxygen during the deposition process (vacuum evaporation, electron-beam evaporation or sputtering); however, the lower oxides of titanium most likely to be formed in this manner (particularly TiO) are strong absorbers of near-IR imaging radiation. In contrast, the likely oxides of aluminum, zinc and bismuth are poor absorbers of such radiation.

Preferred polyester films for use as substrate 104 in this embodiment have surfaces to which the deposited metal adheres well, exhibit substantial flexibility to facilitate spooling and winding over the surface of a plate cylinder, and are substantially transparent to imaging radiation. One useful class of preferred polyester material is the unmodified film exemplified by the MELINEX 442 product marketed by ICI Films, Wilmington, Del., and the 3930 film product marketed by Hoechst-Celanese, Greer, S.C. Also advantageous, depending on the metal employed, are polyester materials that have been modified to enhance surface adhesion characteristics as described above. Suitable polyesters of this type include the ICI MELINEX 453 product. These materials accept titanium, our preferred metal, without the loss of properties. Other metals, by contrast, require custom pretreatments of the polyester film in order to create compatibility therebetween. For example, vinylidenedichloride-based polymers are frequently used to anchor aluminum onto polyesters.

For traditional applications involving plates that are individually mounted to the plate cylinder of a press, the adhesion-promoting surface can also (or alternatively) be present on the side of the polyester film in contact with the cylinder. Plate cylinders are frequently fabricated from material with respect to which the adhesion-promoting surface exhibits a high static coefficient of friction, reducing the possibility of plate slippage during actual printing. The ICI 561 product and the dupont MYLAR J102 film have adhesion-promoting coatings applied to both surfaces, and are therefore well-suited to this environment.

The metal layer 102 is preferably deposited to an optical density ranging from 0.2 to 1.0, with a density of 0.6 being especially preferred. However, thicker layers characterized by optical densities as high as 2.5 can also be used to advantage. This range of optical densities generally corresponds to a thickness of 250 Å or less. While titanium is preferred as layer 102, alloys of titanium can also be used to advantage. The titanium or titanium alloy can also be combined with lower oxides of titanium.

Titanium, its alloys and oxides may be conveniently applied by well-known deposition techniques such as sputtering and electron-beam evaporation. Depending on the condition of the polyester surface, sputtering can prove particularly advantageous in the ready availability of co-processing techniques (e.g., glow discharge and back sputtering) that can be used to modify polyester prior to deposition.

Depending on requirements relating to imaging speed and laser power, it may prove advantageous to provide the metal layer with an antireflective overlay to increase interaction with the imaging pulses. Suitable antireflective materials are well-known in the art, and include a variety of dielectrics (e.g., metal oxides and metal halides). Materials amenable to application in a vacuum can ease manufacture considerably, since both the metal and the antireflection coating can be applied in the same chamber by multiple-source techniques.

The surface layer 100 is preferably a silicone composition, for dry-plate constructions, or a polyvinyl alcohol composition in the case of a wet plate. Our preferred silicone formulation is that described in connection with Examples 1–7 of the '698 patent, applied to produce a uniform coating deposited at 2 g/m$^2$. The anchorage of coating layer 100 to metal layer 102 can be improved by the addition of an adhesion promoter, such as a silane composition (for silicone coatings) or a titanate composition (for polyvinyl-alcohol coatings).

Layer 106 is a metal support. In a representative production sequence, a 2-mil polyester film is coated with titanium and then silicone, following which the coated film is laminated onto an aluminum base having a thickness appropriate to the overall plate thickness desired. In addition to conferring rigidity, lamination in accordance with the present invention includes reflection capability. Support 106 reflects unabsorbed imaging radiation that has passed through the imaging layer 102 and layers thereunder; in the case, for example, of near-IR imaging radiation, aluminum (and particularly polished aluminum) laminated supports provide highly advantageous reflectivity. In this instance, substrate 104, the laminating adhesive 108 and any other layers between layer 102 and support 106 (e.g., a primer coat) should be largely transparent to imaging radiation. In addition, substrate 104 should be relatively thin so that beam energy density is not lost through divergence before it strikes the reflective support. For proper operation in conjunction with the laser equipment described hereinabove, polyester substrates, for example, are preferably no thicker than 2 mils.

In one version of this embodiment, the contrast material is located in laminating adhesive 108. The material observably distinguishes layer 108 from the layer visible to the user (generally layer 102, seen through a transparent layer 100). In order to preserve the above-noted criterion of substantial transparency to imaging radiation, the contrast material should not absorb in the peak emission region of the laser device; in our preferred systems, this is the near-IR region.

Laminating adhesives are materials that can be applied to a surface in an unreactive state, and which, after the surface is brought into contact with a second surface, react either spontaneously or under external influence. In the present context, a laminating adhesive should possess properties appropriate to the environment of the present invention, accommodating the contrast material and substantially passing imaging radiation (both to permit reflection and to avoid undergoing thermal damage as a consequence of absorption); this is readily achieved for near-IR imaging radiation as discussed below. Another useful property is a refractive index not significantly different from that of the substrate 104 (which also, as earlier noted, should be largely transparent to imaging radiation) or the contrast material if present in a solid particulate form.

One category of suitable laminating adhesive is thermally activated, consisting of solid material that is reduced to a flowable (melted) state by application of heat; resolidification results in bonding of the layers (i.e., substrate 104 and the support) between which the adhesive is sandwiched. In this embodiment, the contrast material is mixed with the solid adhesive prior to heating.

Suitable techniques of lamination for applying this type of adhesive are well-characterized in the art, (see, e.g., U.S.

Pat. No. 5,188,032, the entire disclosure of which is hereby incorporated by reference), and are also discussed below. In my production of printing members, I prefer to utilize materials both for substrate 104 and for support 106 in roll (web) form. Accordingly, roll-nip laminating procedures are preferred. In this production sequence, one or both surfaces to be joined are coated with a laminating adhesive, and the surfaces are then brought together under pressure and heat in the nip between cylindrical laminating rollers. In particular, heat is ordinarily supplied by at least one of the two rollers that form the laminating nip, and may be augmented by preheating in advance of the nip. The nip also supplies pressure that creates a uniform area contact between the layers to be joined, expelling air pockets and encouraging adhesive flow.

For example, the mixture of adhesive and contrast material may be applied as a solid (i.e., as a powder that is thermally fused into a continuous coating, or as a mixture of fluid components that are cured to a solid state following application) to one or both of the two surfaces to be joined; thus, a solid adhesive can be applied as a melt via extrusion coating at elevated temperatures, preferably at a thickness of 0.2–1.0 mil, although thinner and heavier layers can be utilized depending on the type of adhesive, application method and necessary bond strength. Following application, the adhesive is chilled and resolidified. Adhesives suitable for this approach include polyamides, copolymers of ethylene and vinyl acetate, and copolymers of ethylene and acrylic acid; specific formulas, including chemical modifications and additives that render the adhesive ideally suited to a particular application, are well-characterized in the art. For this type of adhesive, thermally stable dyes or pigments are required. These include, for example, the FILESTER polymer-soluble dyes, which are suitable for polyester materials; the ORACET line, which is usefully employed in connection with materials such as cellulose acetate, styrenic and acrylic polymers; and the FILAMID line, which is compatible with a range of polyamide materials. All three of these dye lines are supplied by Ciba Geigy.

In a variation to this approach, the adhesive is applied as a waterborne composition. Suitable water-soluble dyes that do not appreciably absorb near-IR radiation include Acid Blue 9 (FD&C Blue 1), Acid Blue 93 and Acid Blue 104.

It may also prove useful to treat the application surface to promote wetting and adhesion of a waterborne adhesive. For example, in the case of a polyester substrate 104 that is to receive such a laminating adhesive, wettability can be improved by prior treatment with one or more polymers based on polyvinylidene dichloride.

In a third, preferred approach, the adhesive layer is cast from a solvent onto one or both of the two surfaces to be joined. This technique facilitates substantial control over the thickness of the applied layer over a wide range, and results in good overall surface contact and wetting onto the surface to which it is applied. Adhesives of this type can include cross-linking components to form stronger bonds and thereby improve cohesive strength, as well as to promote chemical bonding of the adhesive to at least one of the surfaces to be joined (ordinarily to a polymeric layer, such as a polyester substrate 104). They can also be formulated to include a reactive silane (i.e., a silane adhesion promoter) in order to chemically bond the adhesive to an aluminum support 106. Useful solvent-soluble dyes that do not absorb in the near-IR region include ORASOL Blue GN and ORASOL Black RLI (both supplied by Ciba Geigy Corp., Ciba Pigments Division, Newport, Del.); also useful is the Basic Blue 7 product marketed by Pylam Products Co., Inc., Garden City, N.Y. Useful UV-fluorescent agents include the CALCOFLUOR line supplied by BASF Corp., Clifton, N.J.; the LEUCOPHOR line supplied by Sandoz Chemicals Corp., Charlotte, N.C.; and the INTRAWHITE line marketed by Crompton & Knowles Corp., Charlotte, N.C.

One useful family of laminating adhesives that may be cast is based on polyester resins, applied as solvent solutions, and which include a cross-linking component. A representative example of such a formulation is as follows:

| Component | Parts |
|---|---|
| Vitel 3550 | 36 |
| MEK (2-butanone) | 63 |
| Dye | 1 |
| Prepare solution, then add, just prior to coating: | |
| Mondur CB-75 | 4.5 |

Vitel 3550 is a polyester resin supplied by Shell Chemical Co., Akron, Ohio. Mondur CB-75 is an isocyanate cross-linker supplied by Mobay Chemical Corp., Pittsburgh, Pa. "Dye" is intended to refer to any of the solvent-soluble ORASOL dyes, fluorescent brighteners or Basic Blue 7 mentioned above, but the proportion is useful across a broad range of dye materials.

This formulation is applied to the unprocessed side of a titanium-metallized, silicone-coated polyester film as described above, and the MEK solvent is evaporated using heat and air flow. The wet application rate is preferably chosen to result in a final dried weight of 10+/– g/m$^2$. However, it should be emphasized that a wide range of application weights will produce satisfactory results, and the optimal weight for a given application will depend primarily on the materials chosen for the support and substrate 104. The adhesive-coated film is laminated to an aluminum substrate of desired thickness, preferably using roll-nip lamination under heat and pressure.

Pigments suitable for combination with a laminating adhesive include quinacridones (reds, magentas and violets), perylenes (reds), naphtharylides (reds) and, depending on the wavelength of imaging radiation, phthalocyanines (blues). All of these pigments are transparent, a property that usefully minimizes scattering effects. The optimal pigment for a particular application is readily identified by those skilled in the art without undue experimentation. Generally, the necessary loading fraction will exceed that required of a dye.

The above example can be modified to accommodate a pigment by utilizing 5 parts of pigment and reducing the MEK fraction to 59. In a representative production sequence, the Vitel 3550 is dissolved in MEK, and the pigment added to this mixture. The pigment is dispersed, for example, by milling, and the Mondur component added just prior to use as noted above. Depending on the dispersing technique employed, it may prove desirable to withhold some of the MEK in order to build viscosity and thereby facilitate dispersion, then add the withheld MEK to bring the final viscosity to a level suitable for coating.

An alternative to thermally activated laminating adhesives is the class of pressure-sensitive adhesives (PSAs). These are typically cast from a solvent onto the unprocessed side of substrate 104, dried to remove solvent, and finally laminated under pressure to a support. For example, the roll-nip laminating procedure described above can be utilized with no heat applied to either of the rollers. As in the case of thermally activated adhesives, post-application cross-linking capability can be included to improve bonding between surfaces and of the adhesive to the surfaces. The adhesive can also be applied, either in addition or as an alternative to application on substrate 104, to support 106. The PSA can be provided with additives to promote adhesion to support 106, to substrate 104, or to both. Like thermally activated adhesives, PSAs can be applied as solids, as waterborne compositions, or cast from solvents, exhibiting dye and pigment compatibilities as outlined above. Once again, pre-treatment of an application surface to enhance wettability may prove advantageous.

Instead of locating the colorant in adhesive layer 108, one can also place it in substrate 104. In a preferred approach, so-called disperse dyes are used to color clear polyester film; a commercial source of such material is Courtaulds Performance Films, Martinsville, Va. Alternatively, the dye or pigment may be introduced into the uncured polymer from which substrate 104 is formed before this is cross-linked, whereupon it becomes firmly embedded in the polymer matrix, or the dye can instead be a chromophore chemically integrated within the matrix.

In a third approach, the colorant is located in layer 100. Once again, the dye or pigment (e.g., the perylene CI Pigment Red 224) is preferably introduced into the uncured polymer from which layer 100 is formed before this is cross-linked, but chromophores chemically integrated within the matrix can also be employed to advantage (see, e.g., U.S. Pat. No. 5,310,869, which details the integration of chromophores into silicone species).

Figure 2:
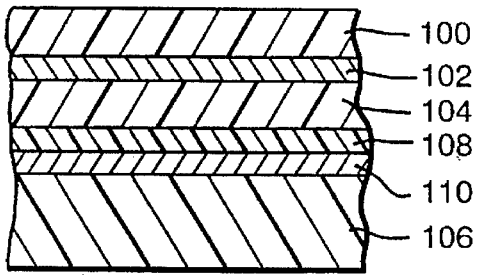
FIG. 2 is an enlarged sectional view of the construction shown in FIG. 1, wherein the base support is metallized to so as reflect imaging radiation.

In another version of the plate shown in FIG. 1, a polyester support 106, metallized with a thin layer of a reflective metal prior to lamination, is employed instead of a metal support; this is shown in FIG. 2. Such an arrangement exhibits substantial flexibility, and is therefore well-suited to plate-winding arrangements. Preferably, the reflective layer 110 is a reflective metal (e.g., aluminum) having a thickness from 200 to 700 Å or more, and support 106 is a heavy (e.g., 7-mil) polyester layer. Layer 110 can be deposited by vacuum evaporation or sputtering directly onto support 106; suitable means of deposition, as well as alternative materials, are described in connection with layer 178 of FIG. 4F in U.S. Pat. No. 4,911,075, the entire disclosure of which is hereby incorporated by reference.

Use of a reflective laminated support is particularly useful in the case of plates having titanium imaging layers, since these tend to pass at least some fraction of incident imaging radiation at the optical densities required for satisfactory performance. Moreover, titanium has been found to respond well to lamination, retaining its adhesion to under- and overlying layers notwithstanding the application of pressure and heat.

Alternatively, the metal layer can be omitted from a polymeric support 106. If support 106 is similar in tonality to layer 102 and layers 100 and 104 are transparent, once again it will be difficult to distinguish imaged from unimaged areas. In this case, the colorant may be located in support 106.

For applications involving automatic plate-material dispensing apparatus, the ease of winding the material around the cylinder represents an important consideration, and favors the use of support materials having a low dynamic coefficients of friction with respect to the cylinder. Ideally, and to the extent practicable, the cylinder and the polyester surface in contact with it are matched to provide low dynamic but high static coefficients of friction. For this reason, it is important to consider both the dynamic and static behavior of any surface treatment in conjunction with a particular type of plate cylinder, and to evaluate this behavior against an unmodified surface.

Figure 3:
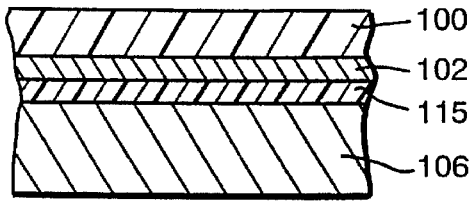
FIG. 3 is an enlarged sectional view of a lithographic plate having a top layer, a radiation-absorptive layer, a thermally insulating layer, and a thermally conductive, dimensionally stable support.

Refer now to FIG. 3, which illustrates a second type of printing member in accordance with the present invention. This construction omits the substrate 104. Because support 106 is thermally conductive, its immediate contact with imaging layer 102 (which may be metal, as illustrated in the figures, or fabricated from other suitable materials such as polymers, as set forth in the '737 patent) will prevent the buildup of radiant energy necessary for local ablation of layer 102. Accordingly, a thermally insulating layer 115 is interposed between imaging layer 102 and thermally conductive layer 106 or 110. This layer and surface layer 100 exhibit opposite affinities for ink and/or fountain solution. If layer 115 is visually transparent, as will ordinarily be the case, layer 102 (present in unimaged regions) will contrast little with support 106; the contrast colorant is therefore located either in layer 100 or layer 115.

Insulating layer 115 exhibits an inherent heat-transport rate much lower than that of a metal, and does not ablate in response to imaging radiation; in particular, preferred materials have coefficients of thermal conductivity no greater than 1% of the coefficient for aluminum (0.565 cal/cm-sec-° C.). Such materials include acrylic polymers (with a typical coefficient of 0.0005 cal/cm-sec-° C.), which can be used to formulate coatings, and polyethylene terephthalate (with a typical coefficient of 0.0004 cal/cm-sec-° C.), which provides the basis for most commercial polyester films. Although flexible polymeric materials are preferred, hybrid materials, which include flexible polymeric components and rigid inorganic components, can also be used to advantage. An example of such a hybrid material is a polysiloxane that includes an integral silicate structure within the polymer backbone.

Dyes are preferred as colorants for layer 115. Although polymeric formulations suitable for this layer can include pigments dispersed therein, such pigments may enhance thermal conductivity. Nonetheless, since the amount of heat actually conducted depends on exposure time as well as inherent heat-transfer capability, simply utilizing a sufficient thickness of moderately absorptive material may prevent heat from a very short imaging pulse from penetrating the layer and reaching support 106 despite the presence of a pigment.

Layer 115 can be applied directly to support 106 as a prime coat. Suitable formulations include:

| Example<br>Component | 2 | 3 |
|---|---|---|
| | Parts | |
| Vitel 2200 | 12.5 | |
| P-84 polyimide solution | | 40.0 |
| 2-Butanone (methyl ethyl ketone) | 69.0 | |
| Toluene | 17.5 | |
| N-methylpyrrolidone (NMP) | | 15.0 |
| Tetrahydrofuran (THF) | | 69.0 |
| Orasol Black RLI | 1.0 | 1.0 |

where Vitel 2200 is a copolyester resin supplied by Shell Chemical Co., Akron, Ohio, and P-84 is a solution of 25% polyimide in NMP supplied by Lenzing Aktiengesellschaft, Lenzing, Austria.

In both examples, the solvents (MEK and toluene in example 1, and NMP and THF in Example 3) are blended before adding the polymer component. The mixture is applied to aluminum stock utilized as support 106 at a coating weight of 1 g/m$^2$, and provides a final coating that is substantially transparent to IR imaging radiation. The formulation of Example 3 exhibits better solvent and heat resistance than the formulation of Example 2; both can be employed as metallizable base coats.

The foregoing constructions can be manufactured by, for example, coating insulating layer 115 onto thermally conductive support 106, applying layer 102 by coating (in the case of a polymer) or by well-known deposition techniques, e.g., sputtering, electron-beam evaporation and vacuum evaporation (in the case of a metal layer), and finally coating layer 100 onto the absorbing layer.

In another approach, layer 115 can represent a laminating adhesive, such as those described above, applied at sufficient thickness to achieve the requisite thermal insulation. Indeed, laminating adhesives are ordinarily organic polymers that exhibit substantial intrinsic thermal-insulating capacity, and can provide adequate insulation even at ordinary application weights. So long as their absorption of imaging radiation is minimal, they will not be ablated and will function as printing layers. For example, polyester-based adhesives are oleophilic and advantageously used with oleophobic surface layers.

Figure 4:
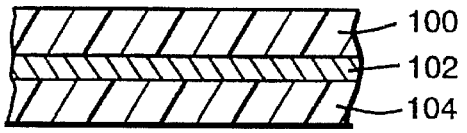
FIG. 4 is an enlarged sectional view of a lithographic plate having a top layer, a radiation-absorptive layer and a substrate that reflects imaging radiation.

Finally, FIG. 4 illustrates the utility of the present inventions in constructions that do not include metal or metalized supports. In this case, substrate 104 includes a material that reflects imaging radiation, and may therefore exhibit little contrast with respect to layer 102. Substrate 104 may be, for example, a polymeric composition containing a pigment that reflects IR radiation. A material suitable for use as an IR-reflective substrate is the white 329 film supplied by ICI Films, Wilmington, Del., which utilizes IR-reflective barium sulfate as the white pigment. To implement the present invention, the colorant is introduced into layer 104 or layer 100 in the manner discussed above.

It will therefore be seen that I have developed an effective approach to imparting contrast to a variety of ablation-type lithographic plate constructions. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A lithographic printing member directly imageable by laser discharge, the member comprising:

a. a topmost first layer which is polymeric;

b. a second layer underlying the first layer; and c. a third layer underlying the second layer;

wherein d. the second layer is formed of a material which is subject to ablative absorption of imaging radiation and the first layer is not;

e. the first and third layers exhibit different affinities for at least one printing liquid selected from the group consisting of ink and an abhesive fluid for ink;

f. at least one of the first and third layers comprises a contrast material that observably distinguishes it from the other layers; and g. the second and third layers are of visually similar tonality in the absence of the contrast material.

2. The member of claim 1 wherein the second layer is metal and the third layer comprises the contrast material and means for reflecting imaging radiation.

3. The member of claim 1 wherein the second layer is a thin layer of titanium or an alloy of titanium and the third layer comprises the contrast material.

4. The member of claim 1 wherein the contrast material is a pigment that does not substantially absorb imaging radiation dispersed in one of the first and third layers, the pigment and the layer in which it is dispersed having substantially similar refractive indices.

5. The member of claim 1 wherein the contrast material is a dye that does not substantially absorb imaging radiation.

6. A laminated lithographic printing member directly imageable by laser discharge, the member comprising:

a. a topmost first layer;

b. a second layer underlying the first layer and formed of a material subject to ablative absorption of imaging radiation whereas the first layer is not;

c. a third layer, substantially visually transparent and substantially transparent to imaging radiation, underlying the second layer, the first and third layers exhibiting different affinities for at least one printing liquid selected from the group consisting of ink and an abhesive fluid for ink;

d. a support to which the third layer is laminated, the support (i) comprising a material that reflects imaging radiation and (ii) not exhibiting substantial observable contrast with respect to the second layer; and e. a layer of laminating adhesive anchoring the third layer to support, the laminating adhesive comprising a contrast material that observably distinguishes it from the second layer.

7. The member of claim 6 wherein the contrast material does not substantially absorb imaging radiation.

8. The member of claim 7 wherein the support comprises means for reflecting imaging radiation.

9. The member of claim 8 wherein the support is metal.

10. The member of claim 9 wherein the second layer is metal.

11. The member of claim 10 wherein the second layer is a thin layer of titanium or an alloy of titanium.

12. The member of claim 8 wherein the support is polymeric and comprises a dispersion of particles that reflect imaging radiation.

13. The member of claim 7 wherein the contrast material is a pigment that does not substantially absorb imaging radiation.

14. The member of claim 7 wherein the contrast material is a dye that does not substantially absorb imaging radiation.

15. The member of claim 6 wherein the contrast material is observable under ultraviolet radiation.

16. The member of claim 6 wherein the contrast material is observable under visible radiation.

17. A laminated lithographic printing member directly imageable by laser discharge, the member comprising:

a. a topmost first layer;

b. a second layer underlying the first layer and formed of a metal subject to ablative absorption of imaging radiation whereas the first layer is not;

c. a third layer, substantially transparent to imaging radiation, underlying the second layer, the first and third layers exhibiting different affinities for at least one printing liquid selected from the group consisting of ink and an abhesive fluid for ink;

d. a support to which the third layer is laminated; and e. a layer of laminating adhesive anchoring the third layer to the support;

wherein f. at least one of the first layer, the third layer, and the adhesive layer comprises a contrast material that observably distinguishes it from the second layer; and g. the second layer and at least one layer thereunder are of visually similar tonality in the absence of the contrast material.

18. The member of claim 17 wherein the contrast material is a pigment that does not substantially absorb imaging radiation.

19. The member of claim 17 wherein the contrast material is a dye that does not substantially absorb imaging radiation.

20. The member of claim 17 wherein the first layer alone comprises the contrast material.

21. The member of claim 17 wherein the first layer is substantially transparent and the third layer alone comprises the contrast material.

22. The member of claim 17 wherein the contrast material is observable under ultraviolet radiation.

23. The member of claim 17 wherein the contrast material is observable under visible radiation.

24. A laminated lithographic printing member directly imageable by laser discharge, the member comprising:

a. a topmost first layer;

b. a second layer underlying the first layer and formed of a material subject to ablative absorption of imaging radiation whereas the first layer is not;

c. a third layer, substantially transparent to imaging radiation, underlying the second layer, the first and third layers exhibiting different affinities for at least one printing liquid selected from the group consisting of ink and an abhesive fluid for ink;

d. a support to which the third layer is laminated; and e. a layer of laminating adhesive anchoring the third layer to the support;

wherein f. the first is substantially transparent and the adhesive layer comprises a contrast material that observably distinguishes it from the second layer.

* * * * *